United States Patent [19]

Tuerk et al.

[11] Patent Number: 4,653,672

[45] Date of Patent: Mar. 31, 1987

[54] ROTARY CLOSURE CAP FOR LOOSE-MATERIAL CONTAINERS

[75] Inventors: Erich Tuerk, Langenfeld; Herbert Bucheler, Erkrath, both of Fed. Rep. of Germany

[73] Assignee: Henkel Kommanditgesellschaft auf Aktien, Duesseldorf, Fed. Rep. of Germany

[21] Appl. No.: 807,761

[22] Filed: Dec. 5, 1985

Related U.S. Application Data

[63] Continuation-in-part of Ser. No. 564,295, Dec. 22, 1983, abandoned.

[30] Foreign Application Priority Data

Jan. 7, 1983 [DE] Fed. Rep. of Germany ..... 3300304

[51] Int. Cl.[4] ..... B65D 51/18

[52] U.S. Cl. ..... 222/153; 222/480; 222/485; 222/548; 222/553; 215/216

[58] Field of Search ..... 222/153, 485, 548, 553, 222/559, 498, 499, 478, 480, 545; 215/216, 219, 215/220, 221

[56] References Cited

U.S. PATENT DOCUMENTS

| | | | |
|---|---|---|---|
| 749,671 | 1/1904 | Hall . | |
| 2,381,207 | 8/1945 | Coleman | 215/219 X |
| 2,826,345 | 3/1958 | Thomsen . | |
| 3,073,468 | 1/1963 | Arneson . | |
| 3,141,579 | 7/1964 | Medlock | 222/553 X |
| 3,209,964 | 10/1965 | Knight | 222/499 X |
| 3,261,516 | 7/1966 | Allen | 222/548 |
| 3,262,614 | 7/1966 | Allen | 222/548 X |
| 3,276,643 | 10/1966 | Klygis . | |
| 3,357,605 | 12/1967 | Chadfield | 222/485 |
| 3,365,106 | 1/1968 | Lodding et al. | 222/485 |
| 3,529,752 | 9/1970 | Nyquist | 222/480 |
| 3,881,639 | 5/1975 | Herip | 222/498 X |
| 4,020,965 | 5/1977 | Northup | 215/220 X |
| 4,500,016 | 2/1985 | Funfstuck | 222/498 X |
| 4,548,331 | 10/1985 | Montgomery | 222/153 X |

FOREIGN PATENT DOCUMENTS

| | | | |
|---|---|---|---|
| 2233318 | 1/1973 | Fed. Rep. of Germany | 215/221 |
| 788685 | 10/1935 | France | 22/548 |
| 598076 | 4/1978 | Switzerland . | |
| 357202 | 9/1931 | United Kingdom | 222/478 |
| 1582628 | 1/1981 | United Kingdom | 222/485 |

*Primary Examiner*—Joseph J. Rolla
*Assistant Examiner*—Edward S. Ammeen
*Attorney, Agent, or Firm*—Ernest G. Szoke; Henry E. Millson, Jr.; Real J. Grandmaison

[57] ABSTRACT

A rotary closure cap for loose-material containers consisting of a cap portion and of a rotary disc mounted thereon for rotation about an axis. These components comprise in their main surfaces perpendicular to the axis, pouring openings and a locking assembly which may successively be brought into coincidence by relative movements. The locked position is intended to be childproof. According to the invention, the locking assembly consists of a detent button arranged on a spring tongue of the cap portion and of a detent hole through the rotary disc which is large enough for an engaged detent button to be pushed down by finger pressure. The operation of the rotary closure cap requires both depression of the detent button and rotation of the rotary disc simultaneously.

11 Claims, 4 Drawing Figures

ROTARY CLOSURE CAP FOR LOOSE-MATERIAL CONTAINERS

This application is a continuation-in-part of application Ser. No. 564,295, filed Dec. 22, 1983 now abandoned.

BACKGROUND OF THE INVENTION

This invention relates to a rotary closure cap for loose-material containers, consisting of a cap portion designed to be fixed to the container with a rotary disc mounted thereon for rotation about an axis, the cap portion and the rotary disc comprising pouring openings designed to be brought successively into coincidence by turning movements relative to one another and locking means in their main surfaces extending substantially perpendicularly of the axis.

Closures of the above-mentioned type are known for storage and sprinkling containers for salt and spices. In certain angular positions, the rotary disc mounted for rotation about an axis on the top of the cap portion can have several openings of different size or different shape and also a closing and at the same time locking angular position, the openings and the closed position being designed to coincide with corresponding openings and blocking zones of the cap portion. The mutual angular intervals between the starting angular positions on the cap portion and the rotary disc differ from one another to such an extent that two corresponding pairs of openings cannot coincide at the same time. These known rotary closures are not entirely suitable for storing loose materials, for example, caustic cleaners, which have to be kept away from children.

OBJECTS OF THE INVENTION

An object of the present invention is to provide a rotary closure cap which, in the closed position, can be locked in such a childproof manner that children at the dangerous age are normally not able to open the container in question.

Another object of the present invention is the development of an improvement in a rotary closure cap for loose-material containers consisting of (1) a cap portion designed to be attached to the container and (2) a rotary disc mounted on said cap portion and rotatable about an axis, said cap portion and said rotary disc being supplied with pouring openings designed to be brought successively into coincidence with each other by rotational movement of said cap portion about said axis and locking means adapted to hold said rotary disc stationary, the improvement consisting essentially in that said locking means consists of a spring mounted detent button on the surface of said cap portion perpendicular to said axis which pushes against the surface of said rotary disc and at least one detent hole the same distance from said axis as said detent button through said rotary disc which is large enough, whereby said spring mounted detent button engaged in said at least one detent hole against rotation of said rotary disc, can be depressed by finger pressure sufficiently whereby said detent button is disengaged from said detent hole and said rotary disc can be rotated.

These and other objects of the invention will become more apparent as the description thereof proceeds.

THE DRAWINGS

DESCRIPTION OF THE INVENTION

Figure 1:
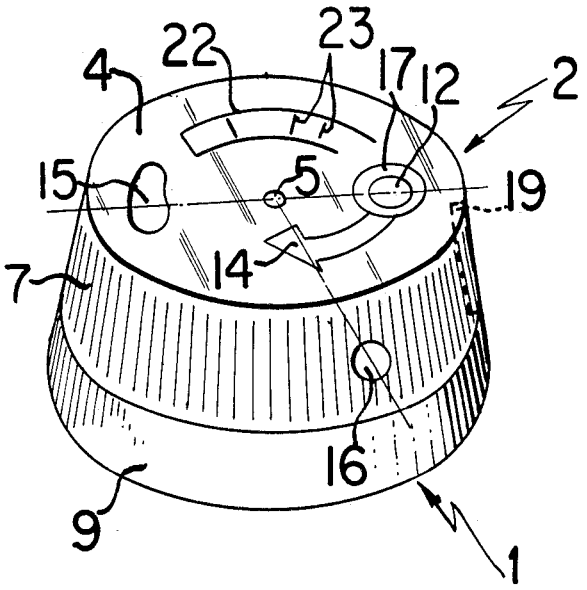
FIG. 1 is a perspective view of the assembled rotary closure cap for loose-material containers.

In the rotary closure cap of the prior art described at the beginning, consisting of a cap portion to be fixed to the container to be closed with a rotary disc mounted thereon and designed to be locked in a closed position by locking means, the solution provided by the present invention is characterized in that the locking means consists of a detent button of the cap portion which pushes against the rotary disc under spring pressure and of a detent hole through the rotary disc which is large enough for the engaged detent button to be pushed down by finger pressure.

The present invention, therefore, is an improvement in a rotary closure cap for loose-material containers consisting of (1) a cap portion designed to be attached to the container and (2) a rotary disc mounted on said cap portion and rotatable about an axis, said cap portion and said rotary disc being supplied with pouring openings designed to be brought successively into coincidence with each other by rotational movement of said cap portion about said axis and locking means adapted to hold said rotary disc stationary, the improvement consisting essentially in that said locking means consists of a spring mounted detent button on the surface of said cap portion perpendicular to said axis which pushes against the surface of said rotary disc and at least one detent hole the same distance from said axis as said detent button through said rotary disc which is large enough, whereby said spring mounted detent button engaged in said at least one detent hole against rotation of said rotary disc, can be depressed by finger pressure sufficiently whereby said detent button is disengaged from said detent hole and said rotary disc can be rotated.

The invention provides a closure for powder containers which is childproofed in the respect that two different manipulations—pressing down the button and at the same time rotation in the direction of the arrow—have to be carried out at one and the same time.

According to the invention, the configuration of the spring element carrying the detent button is particularly important. The detent button is preferably situated on a spring tongue cut out of the surface of the cap portion. By virtue of the chosen construction of this pushbutton mechanism, including the choice of material, the dimensions and the geometric form, a wide range is available for adjusting the spring characteristic.

According to another aspect of the invention, the rotary disc comprises a peripheral wall (outer peripheral wall) overlapping a peripheral wall (inner peripheral wall) attached to the cap portion in the manner of a cap, the peripheral walls preferably having substantially the same inclination with respect to the axis of rotation extending perpendicularly on the main surfaces and each comprising at least one sprinkling or pouring opening which can be brought into coincidence with the other opening by relative movement. In this way, the invention provides a powder container in which, in addition to the childproofing, at least one pair of openings can be adjusted in the top of the cap for pouring and at least one pair of openings suitable for lateral sprinkling can be adjusted in the peripheral wall. The lateral sprinkling opening, which enables the issuing stream of loose material to be better directed, is particularly advantageous for proportioning powders which should not be spilled either because of their high value or because they are harmful. Accordingly, another major advantage afforded by the invention is that the rotary closure cap which is particularly suitable for packaging dangerous materials is childproof in the closed position and is made even safer in that respect by the additional sealing effect of the peripheral walls applied frustoconically or cylindrically to the surface of the rotary disc and the cap portion.

One embodiment of the invention is described by way of example in the following with reference to the accompanying diagrammatic drawings, wherein:

FIG. 1 is a perspective view of an assembled and fitted rotary closure cap.

Figure 2:
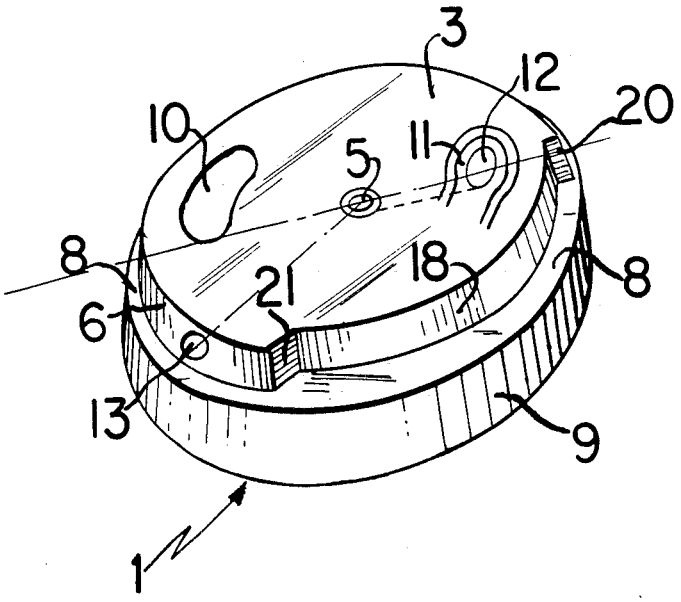
FIG. 2 is a perspective view of the upper side of the cap portion attachable to the container to be closed.

FIG. 2 is a perspective view of the upper side of the cap portion to be fixed to the container to be closed.

Figure 3:
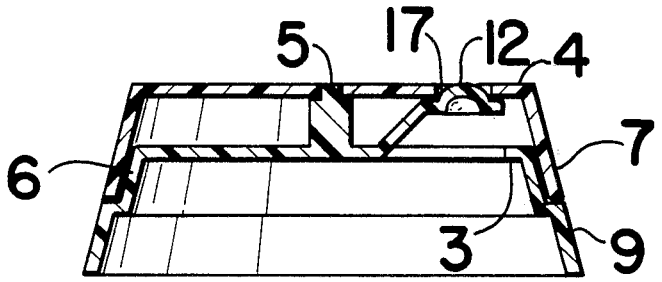
FIG. 3 is a cross-section view along line III—III of FIG. 1, showing operation of the detent button.

FIG. 3 is a cross-section view along line III—III of FIG. 1, showing operation of the detent button.

Figure 4:
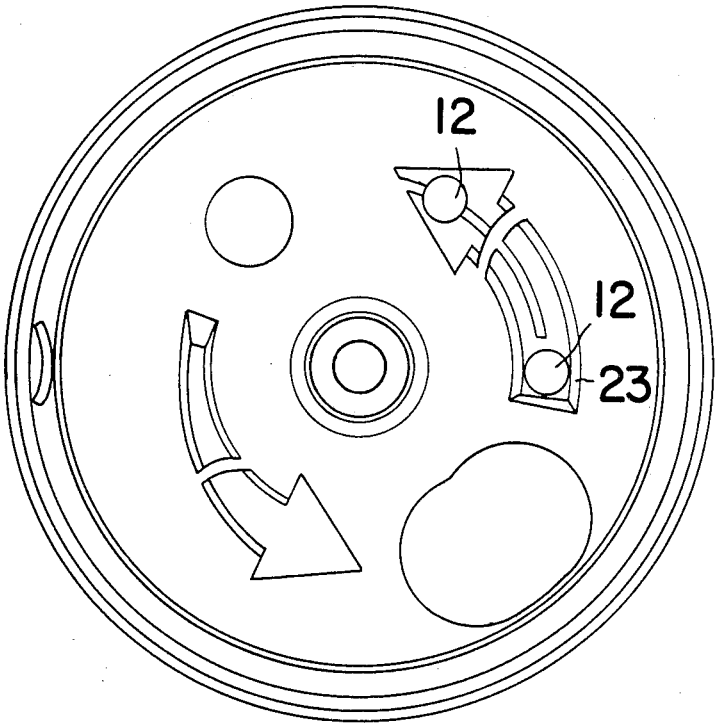
FIG. 4 is a cross-section view of FIG. 1 showing operation of the locking means for the detent button.

FIG. 4 is a cross-section view of FIG. 1 showing operation of locking means 23 for the detent button 12.

The rotary closure cap shown in FIGS. 1 and 2 consists of two parts, namely the cap portion 1, shown in particular in FIG. 2, and the rotary disc 2, shown in FIG. 1. The rotary disc 2 is mounted on the cap portion 1 for rotation about an axis pin 5 which extends perpendicularly of the main surface 3 of the cap portion and main surface 4 of the rotary disc 2, respectively. Where the components of the rotary closure cap are made of plastic, as is preferably the case, the rotary connection in the axis pin 5 is a co-molded rivet of the same material. The cap portion 1 and the rotary disc 2 each comprise a co-molded cylindrical or frustoconical peripheral wall 6 (for the cap portion) and 7 (for the rotary disc). A step 8 may be formed in the peripheral wall 6 of the cap portion 1 to ensure a smooth fit between the peripheral wall 7 of the rotary disc 2 and the lower part 9 of the peripheral wall 6 of the cap portion 1.

In the embodiment illustrated, the main surface 3 of the cap portion 1 contains a pouring opening 10 and a detent button 12 arranged on a spring tongue 11 cut into the main surface 3. In addition, the cap portion 1 comprises a relatively small sprinkling opening 13 in the upper part of its peripheral wall 6. A pouring opening 15 and a sprinkling opening 16 and also a detent hole 17 in the rotary disc 2 may be brought into coincidence with the openings 10 and 13 and the detent button 12 of the cap portion 1 by rotation in the direction of the arrow 14. As can be seen, the angular intervals between the pouring, sprinkling and locked positions on the cap portion 1 and the rotary disc 2 differ in such a way that, wherever the disc is turned, two associated pairings cannot be brought into coincidence at the same time.

For operating the rotary closure cap, it is particularly favorable for the outer peripheral wall 7 belonging to the rotary disc 2, which overlaps the inner peripheral wall 6 belonging to the cap portion 1 in the manner of a cap, to be provided on its inner surface with a dog 19 engaging in a groove 18 provided in the inner peripheral wall 6 and for the dog 19 shown in chain lines in FIG. 1 to be moved back and forth in the groove 18, when the rotary disc 2 is turned, from a first stop 20 associated with the locked position to a second stop 21 associated with the open position furthest away from the closed position via all the open and locked pairings with the cap portion 1. In addition, to fix the particular open and locked pairings, it is also favorable for a locking stud or dog 23 comprised of two downward facing ridges between which detent button 12 is biased, effecting a slight locking of rotation which is easily overcome due to the sloping sides of the detent button 12, which locks when an open pairing coincides and which may be released by turning the rotary disc 2, to be formed on that side of the main surface 4 of the rotary disc 2 which faces the cap portion 1 on an arc 22 around the axis pin 5 containing the detent hole 17. It can be seen from FIG. 4 that locking means 23 comprises of two downwardly facing ridges 23′ and 23″ between which detent button 12 may be biased to cause a slight locking of detent button 12.

The preceding specific embodiment is illustrative of the practice of the invention. It is to be understood, however, that other expedients known to those skilled in the art or disclosed herein may be employed without departing from the spirit of the invention or the scope of the appended claims.

We claim:

1. A rotary closure cap for loose-material containers comprising (1) a cap portion attached to a container and (2) a rotary disc mounted on said cap portion and rotatable about an axis pin which extends perpendicularly of a main surface of said cap portion and said rotary disc, said rotary disc and said main surface of said cup portion having a circumferential edge, said cap portion and said rotary disc having pouring openings brought successively into coincidence with each other by relative rotational movement of said cap portion and said rotary disc about said axis pin, locking means holding said rotary disc stationary in a closed position, wherein said locking means comprises a spring mounted detent button on the main surface of said cap portion perpendicular to said axis pin and which pushes against the inner surface of said rotary disc and at least one detent hole in said rotary disc located the same distance from said axis pin as said detent button, said detent button and said detent hole being radially inward from said circumferential edges whereby said spring mounted detent button when engaged in said at least one detent hole against rotation of said rotary disc can be depressed through said hole in said rotary disc by sufficient finger pressure to disengage said detent button from said detent hole and said rotary disc can be rotated.

2. The rotary closure cap of claim 1 wherein said spring mounted detent button is arranged on a spring tongue cut out of the main surface of said cap portion.

3. The rotary closure cap of claim 1 wherein said rotary disc comprises an outer peripheral wall overlapping an inner peripheral wall formed on said cap portion in the manner of a cap and in that said peripheral walls each comprise at least one sprinkling or pouring opening which may be brought into coincidence with the respective other opening by relative rotary movement of said rotary disc and said cap portion.

4. The rotary closure cap of claim 2 wherein said rotary disc comprises an outer peripheral wall overlapping an inner peripheral wall formed on said cap portion in the manner of a cap and in that said peripheral walls each comprise at least one sprinkling or pouring opening which may be brought into coincidence with the respective other opening by relative rotary movement of said rotary disc and said cap portion.

5. The rotary closure cap of claim 1 wherein a dog provided on the inner surface of an outer peripheral wall of said rotary disc engages a groove formed on the outer surface of an inner peripheral wall of said cap portion, said peripheral wall of said rotary disc overlapping said peripheral wall of said cap portion in the manner of a cap whereby said dog is moved back and forth in the groove when the rotary disc is turned from a first stop associated with the closed position to a second stop associated with the open position furthest away from the closed position.

6. The rotary closure cap of claim 2 wherein a dog provided on the inner surface of an outer peripheral wall of said rotary disc engages a groove formed on the outer surface of an inner peripheral wall of said cap portion, said peripheral wall of said rotary disc overlapping said peripheral wall of said cap portion in the manner of a cap whereby said dog is moved back and forth in the groove when the rotary disc is turned from a first stop associated with the closed position to a second stop associated with the open position furthest away from the closed position.

7. The rotary closure cap of claim 3 wherein a dog provided on the inner surface of the outer peripheral wall of said rotary disc engages a groove formed on the outer surface of the inner peripheral wall of said cap portion, said peripheral wall of said rotary disc overlapping said peripheral wall of said cap portion in the manner of a cap whereby said dog is moved back and forth in the groove when the rotary disc is turned from a first stop associated with the closed position to a second stop associated with the open position furthest away from the closed position.

8. The rotary closure cap of claim 4 wherein a dog provided on the inner surface of the outer peripheral wall of said rotary disc engages a groove formed on the outer surface of the inner peripheral wall of said cap portion, said peripheral wall of said rotary disc overlapping said peripheral wall of said cap portion in the manner of a cap whereby said dog is moved back and forth in the groove when the rotary disc is turned from a first stop associated with the closed position to a second stop associated with the open position furthest away from the closed position.

9. The rotary closure cap of claim 3 wherein said openings in said cap portion and said rotary disc are sufficiently large for pouring and wherein a pair of openings in the peripheral walls of said cap portion and said rotary disc are provided for lateral sprinkling provided however, that wherever said rotary disc is rotated, the pair of openings for pouring and the pair of openings for lateral sprinkling cannot be brought into coincidence at the same time.

10. The rotary closure cap of claim 4 wherein said openings in said cap portion and said rotary disc are sufficiently large for pouring and wherein a pair of openings in the peripheral walls of said cap portion and said rotary disc are provided for lateral sprinkling provided however, that wherever said rotary disc is rotated, the pair of openings for pouring and the pair of openings for lateral sprinkling cannot be brought into coincidence at the same time.

11. The rotary closure cap of claim 1 including a locking stud comprising two downwardly facing ridges located on that surface of said rotary disc which faces said cap portion and between which said detent button may be biased when a pair of pouring openings coincides and can be released by turning the rotary disc.

* * * * *